US005559679A

United States Patent [19]

Liedtke

[11] Patent Number: 5,559,679

[45] Date of Patent: Sep. 24, 1996

[54] LIGHTING DEVICE FOR VEHICLES

[75] Inventor: Frieder Liedtke, Dettingen, Germany

[73] Assignee: Robert Bosch GmbH, Stuttgart, Germany

[21] Appl. No.: 423,035

[22] Filed: Apr. 17, 1995

[30] Foreign Application Priority Data

May 26, 1994 [DE] Germany ..... 44 18 399.2

[51] Int. Cl.[6] ..... B60Q 1/04

[52] U.S. Cl. ..... 362/61; 362/226; 439/537

[58] Field of Search ..... 362/61, 226; 439/537, 439/336, 340, 672, 673, 674, 666, 667

[56] References Cited

U.S. PATENT DOCUMENTS

| | | | |
|---|---|---|---|
| 2,982,939 | 5/1961 | Kirk | 439/672 |
| 3,668,603 | 6/1972 | Burgess et al. | 439/336 |
| 3,810,072 | 5/1974 | Moore | 439/336 |
| 4,040,709 | 9/1977 | Dola et al. | 339/125 L |
| 5,087,213 | 2/1992 | Drapcho et al. | 439/672 |
| 5,111,368 | 5/1992 | Suzuki et al. | 362/61 |
| 5,228,766 | 7/1993 | Makita et al. | 362/61 |
| 5,343,370 | 8/1994 | Ohashi et al. | 362/61 |
| 5,411,411 | 5/1995 | Ogawa et al. | 439/336 |

FOREIGN PATENT DOCUMENTS

| | | |
|---|---|---|
| 2124930 | 11/1972 | Germany . |
| 3715532 | 11/1988 | Germany . |

*Primary Examiner*—Denise L. Gromada
*Assistant Examiner*—Alfred Basichas
*Attorney, Agent, or Firm*—Michael J. Striker

[57] ABSTRACT

A lighting device for vehicles has a housing, at least one light source, and a holder fastenable to the housing and formed so that the at least one light source is insertable in the holder. The holder is provided with at least one electrical contact element on which the light source comes to rest. At least one electrical lead is connected with the at least one electrical contact and connectable to a voltage source. The holder has a covering composed of an electrically insulating material. A plug includes a plug part, and at least one electrical connecting element connected with the plug part is arranged on one part of the housing. The connecting element is bringable to rest at the contact element of the holder under the action of a spring force in built-in position of the holder in the housing.

15 Claims, 3 Drawing Sheets

LIGHTING DEVICE FOR VEHICLES

BACKGROUND OF THE INVENTION

The present invention relates to a lighting device for vehicles.

More particularly, it relates to a lighting device for vehicles, which has at least one light source and a holder formed for supporting the light source and provided with at least one electrical contact element.

Such a lighting device is disclosed by DE-A 21 24 930. The lighting device is designed in the form of a lamp and has a reflector into which a light source can be inserted. For the light source a holder is provided, into which the light source can be inserted and which can be fastened in an opening in the reflector vertex. The holder has electrical contact elements, on which the light source comes to rest and which can be connected to at least one electrical lead for connecting to a voltage source. The electrical lead is led in from the outside to the holder and requires a seal on the holder. the holder has a covering in the form of a cap made of electrically insulating material. At the point of connection of the holder to the reflector, a seal is likewise necessary. Since the holder is always connected to the electrical lead, manipulation of the holder for the assembly or disassembly of the light source is made more difficult.

In the case of lighting devices for vehicles, it is an aim to keep the number of separate electrical leads necessary for them small and to combine the latter in one single cable loom. In addition, it is an aim to provide as few connection points as possible for the electrical leads on the lighting device. These requirements cannot be fulfilled in the case of the known lighting device.

SUMMARY OF THE INVENTION

Accordingly, it is an object of the present invention to provide a lighting device for vehicles, which avoids the disadvantages of the prior art.

In keeping with these objects and with others which will become apparent hereinafter, one feature of the present invention resides, briefly stated, in a lighting device of the above mentioned general type which has a plug part of a plug connection for connecting to at least one electrical lead arranged in part of the lighting device, and the at least one electrical connecting element of the holder connected to the plug part is arranged on the one part on the lighting device, and the connecting element is bringable to rest on the at least one contact element on the holder under the action of a spring force in a built-in position of the holder on the lighting device.

When the lighting device is designed in accordance with the present invention, it has the advantage, in contrast, that the holder itself is not directly connected to the at least one electrical lead and its manipulation is hence significantly simplified. Furthermore, only one seal is necessary on the lighting device at the point of connection to the holder.

In accordance with another feature of the present invention, the housing device has an opening for passing a section of the holder, and the opening has a plurality of radial cutouts at its edge, so that the section of the holder passing through the opening has a plurality of corresponding radial projections with shoulder pointing axially in a direction opposite to the insertion direction of the holder. The shoulders engage on the inside of the housing during rotation of the holder in a fastening direction. With this construction a simple and reliably operating fastening of the holder is achieved.

In accordance with a further feature of the present invention a reflector is arranged in the housing and has an opening arranged at least approximately coaxially to the opening of the housing. Both openings have in each case a plurality of radial cutouts at their edge, and the section of the holder passing through the openings correspondingly has a plurality of radial projections with shoulders pointing axially in a direction opposite to the insertion direction. The shoulders engage on the inside of the reflector during rotation of the holder in the fastening direction. The fastening of the holder in accordance with these features offers the advantage that the light source is aligned particularly accurately with reference to the reflector.

A collar can be arranged on the housing at least approximately coaxially surrounding the opening, so as to stick out to the outside. The covering of the holder can have a section at least approximately coaxially surrounding the collar toward the outside of the housing, and the section cooperates with the collar for sealing the opening. These features provide a simple and reliable operating sealing of the point of connection between the holder and the housing.

The connecting element can project outwards inside the collar. The section of the covering can be radially elastically deformable, and the collar can be designed tapering away from the housing on its outer surface. Therefore a secure seal can be achieved without an additional component, such as for example a sealing ring.

In accordance with still a further feature of the present invention, an additional collar can surround the first mentioned collar and the section of the covering and stick out to the outside. In this way a protection is formed against splash water.

Finally, at least one electrical lead device for contacting a light source of the headlight can be additionally connected to the plug part. Therefore only one plug part is necessary on the lighting device, via which all the light sources of the lighting device can be connected to the voltage source.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
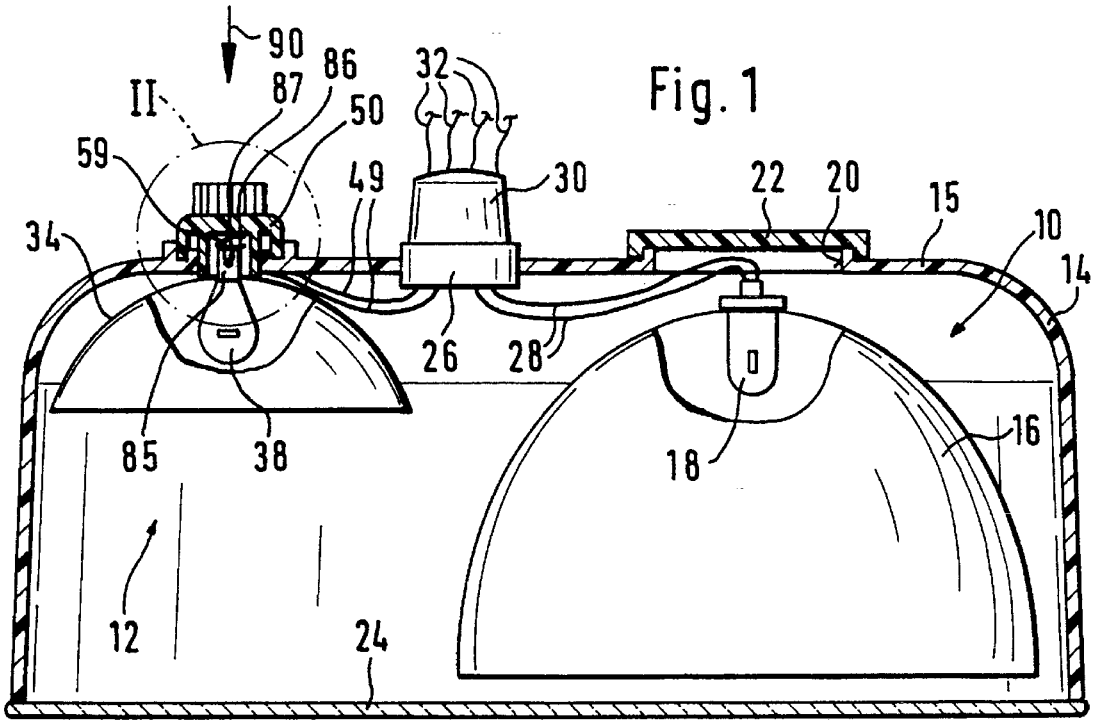
FIG. 1 shows a lighting device for vehicles in a horizontal longitudinal section.

A lighting device for vehicles, especially motor vehicles, shown in FIGS. 1 to 6, comprises a headlight 10 and a lamp 12 arranged alongside the latter, which are arranged in a common housing 14 consisting, for example, of plastic. The headlight 10 has a reflector 16 which is arranged so as to be adjustable in the housing 14. A light source 18 is inserted into the reflector 16. The housing 14 has, in its rear wall 15 in the region of the headlight 10, an opening 20, through which the light source 18 is accessible and which can be closed by a cap 22. The light exit opening of the housing 14 is covered with a covering pane 24 which is transparent to light. A plug 26 is arranged on the rear wall 15 of the housing 14. Inside the housing 14, electrical leads 28 lead off from the plug 26 to the light source 18. A plug part 30 can be connected to the plug part 26 and is connected to electrical leads 32 which lead to a voltage source via a light switch.

Figure 3:
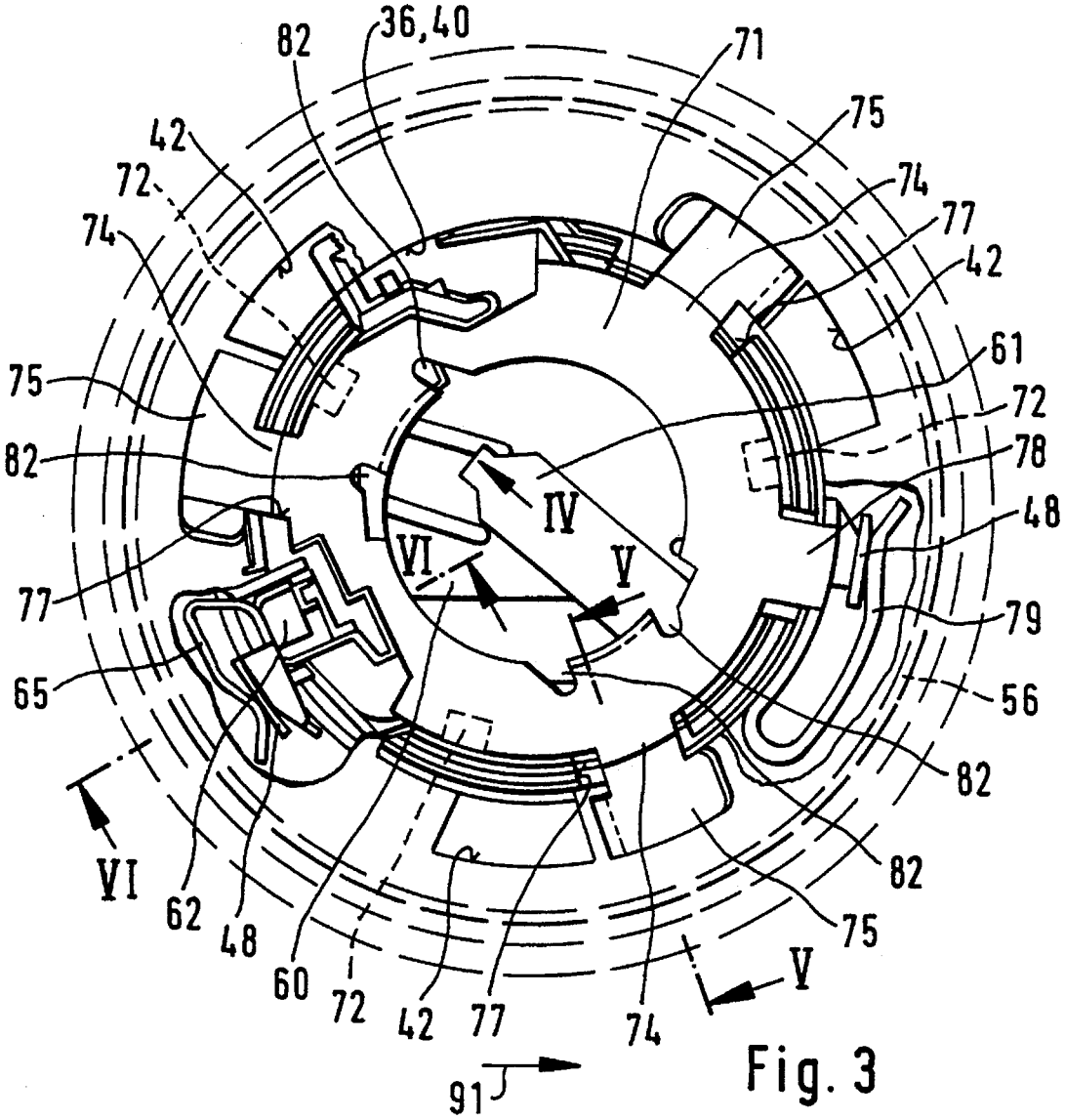
FIG. 3 shows an elevation of the lighting device of FIG. 2 in the direction of the arrow III in FIG. 2; without inserted light source.

The lamp 12 has a reflector 34 arranged inside the housing 14. The reflector can be designed in one piece with the rear wall 15 of the housing 14 or as a separate part. As shown in FIG. 3, the reflector 34 has, in its vertex arranged toward the rear wall of the housing 14, an approximately circular opening 36, through which a light source 38 can be introduced. The vertex of the reflector 34 rests at least in part on the inside of the rear wall 15 of the housing 14. The housing 14 has, in its rear wall 15, a further approximately circular opening 40, which is arranged at least approximately coaxially to the opening 36 of the reflector 34. The two openings 36 and 40 each have at their edge a plurality, for example three, of radial cutouts 42. The cutouts 42 of the two openings 36 and 40 are arranged in alignment. From the rear wall 15 of the housing 14 a collar 44 sticks out in one piece to the outside. The collar is designed such that it at least approximately coaxially surround the opening 40. The collar 44, at its outer surface pointing radially away from the opening 40, is designed to be approximately conically tapering away from the rear wall 15, at least in its region arranged close to the rear wall 15. A further collar 46, at least approximately coaxially surrounding the collar 44, sticks out in one piece to the outside from the rear wall 15.

Figure 2:
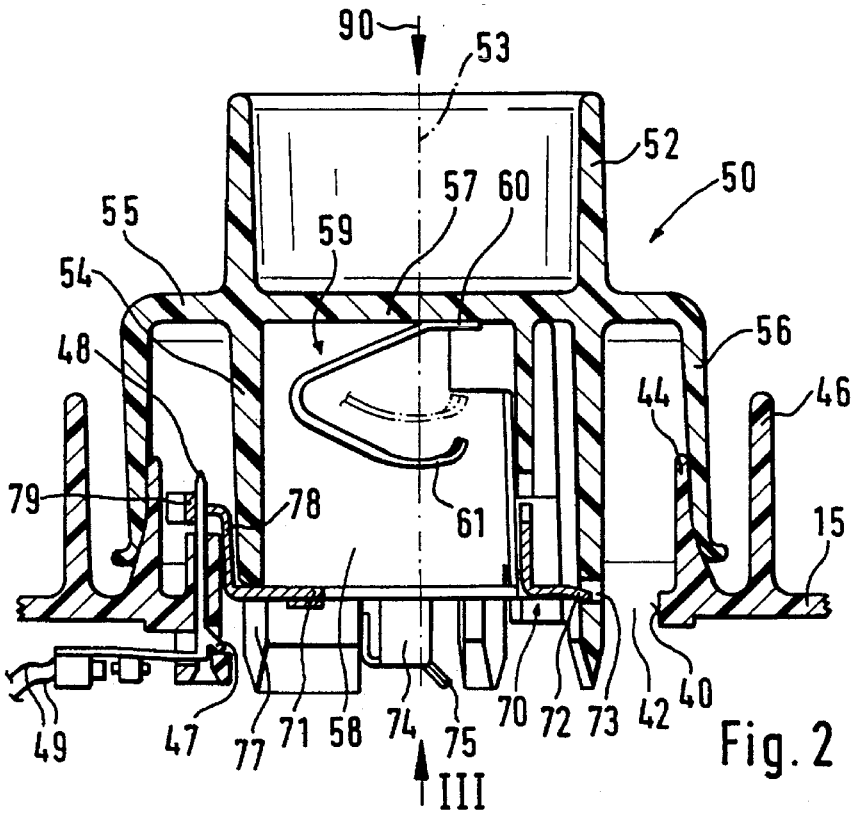
FIG. 2 shows a section, designated by II, of the lighting device from FIG. 1, in an enlarged representation.

Arranged alongside the edge of the opening 40, on the inside of the rear wall 15 of the housing 14, there is a plurality, for example two, of electrical connecting elements 48. They can be designed, for example, as flat-pin connectors. In FIG. 2, only one of the connecting elements 48 can be seen, while in FIG. 3 both connecting elements 48 are shown. The connecting elements 48 are arranged distributed on a somewhat larger diameter than the diameter of the opening 40 and project outward through corresponding openings in the rear wall 15 to the rear side of the housing 14. Inside the housing 14, the connecting elements 48 are connected to electrical leads 49, which are in turn connected to the plug part 26. The connecting elements 48 are fastened on the inside of the ear wall 15, for example by being hooked onto the rear wall 15 by means of hooks 47 brought out from the said elements.

The light source 38 of the lamp 12 can be inserted into a holder 50 which is shown in FIG. 2. The holder 50 has a covering 52 made of electrically insulating material, for example plastic. The covering 52 has an essentially circular-cylindrical main body 54 having a longitudinal axis 53 and is designed smaller in cross-section than the opening 40 in the housing rear wall 15 and the opening 36 in the reflector 34. Integrally molded on the main body 54 there is a flange 55 sticking outward radially to the longitudinal axis 53. A further essentially circular-cylindrical section 56 is integrally molded on the flange, on the outside of the rear wall 15 and approximately coaxial to the main body 54. The section 56 is designed widening conically on its inner surface to its free end region and can be expanded in a radial elastic manner. In the region of the flange 55, a closed bottom 57 is integrally molded on the main body 54, radially inward to the longitudinal axis 53. Thereby a depression 58 open only to the interior of the housing 14 is formed on the main body 54.

Figure 6:
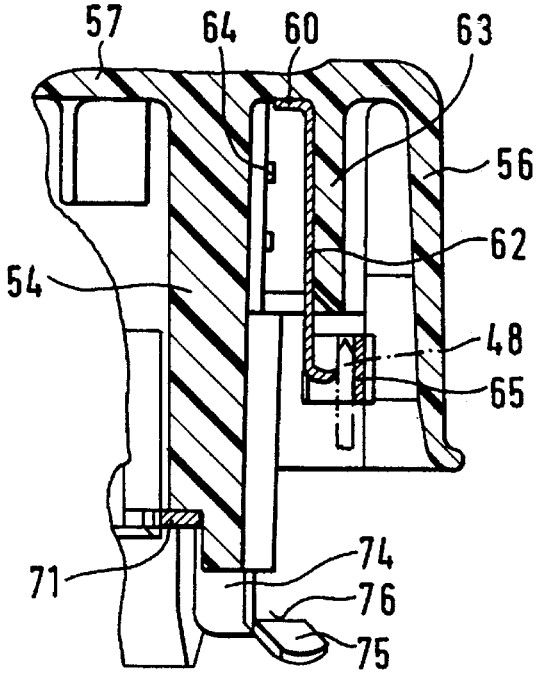
FIG. 6 shows a partial section through the lighting device along line VI—VI in FIG. 3.

A first electrical contact element 59 is inserted into the depression 58 of the main body 54. The contact element consists of sheet metal and rests on the bottom 57 with a planar section 60. It has a contact arm 61 which sticks out from the bottom 57, is approximately V-shaped and can be elastically deformed toward the bottom 57. A further section 62 of the contact element 59 is, as shown in FIG. 6, bent over on the planar section 60 and runs approximately parallel to the wall of the main body 54, away from the bottom 57. Inside the main body 54, proceeding from the bottom 57 in sections, a wall 63 is designed, which runs approximately parallel to the wall of the main body 54, along the longitudinal axis 53, but does not reach as far as the main body 54. The section 62 of the contact element 59 rungs between the wall 63 and the main body 54 and is hooked in there by means of one or more hooks 64 brought out from the said section, so that the contact element 59 is held. The end region of the section 62 projects in the direction of the longitudinal axis 53 beyond the wall 63 and is bent over radially outward. Thereby it projects radially beyond the main body 54 but is still arranged inside the cylindrical section 56 of the covering 52. The end 65 of the section 62 is designed bent in a U-shape in a plane at right angles to the longitudinal axis 53, as can be seen in FIG. 3.

Figure 4:
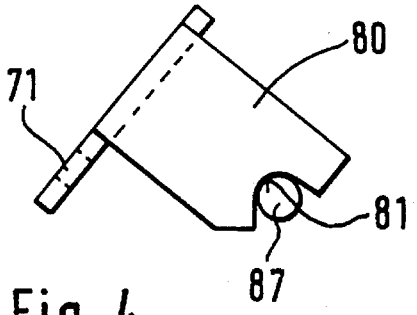
FIG. 4 shows a partial elevation in the direction of the arrow IV in FIG. 3.

In addition, a second contact element 70 in the form of a lamp carrier is inserted into the main body 54. The lamp carrier can consist of sheet metal. The lamp carrier 70 has an annular planar section 71, which can best be seen in FIG. 3. It is arranged approximately at right angles to the longitudinal axis 53 and, for example, three tongues stick out from it radially outward. They engage in corresponding depressions or openings 73 for fastening the lamp carrier 70 to the main body 54, as is shown in FIG. 2. For example, three arms 74 are bent over on the outer edge of the annular section 71, pointing away from the bottom 57, approximately parallel to the longitudinal axis 53. The free end regions 75 of the arms are in turn bent over in such a way that they run approximately in a plane at right angles to the longitudinal axis 53. Shoulders 76 pointing toward the bottom 57 are formed on the free end regions 75, and one end of the end regions 75 is bent over away from the bottom 57. The arms 74 are arranged in corresponding recesses 77 in the main body 54. The recesses extend, proceeding from the end of the main body 54 pointing away from the bottom 57, as far as the annular section 71. The arms 74, at their ends arranged on the annular section 71, rest on the bottom of the recesses 77 and thereby the position of the lamp carrier 70 in the direction of the longitudinal axis 53 is determined. The end regions 75 of the arms 74 project radially outward beyond the main body 54 but are arranged on a smaller diameter than the internal diameter of the cylindrical section 56 of the covering 52. In the direction of the longitudinal axis 53, the end regions 75 are arranged approximately at the level of the end of the main body 54. In addition, on the outer edge of the annular section 71, a carrier 78 is bent over, extending approximately parallel to the longitudinal axis 53 toward the bottom 57, as is shown in FIG. 2. The free end region 79 of the carrier 78 is designed bent in a U-shape in a plane at right angles to the longitudinal axis 53, as shown in FIG. 3. The end region 79 is arranged between the main body 54 and the cylindrical section 56 of the covering 52. The end region 79 is arranged in the same direction as the end region 65 of the contact element 59, that is to say the free ends of the limbs of the end regions 65 and 79 point around the longitudinal axis 53 in the same peripheral direction. On the inner edge of the annular section 61, distributed at a distance from each other around its periphery, two feet 80 shown in FIGS. 3 and 4 are bent over, extending approximately parallel to the longitudinal axis 53 toward the bottom 57. The feet are, for example, arranged on the periphery at the same locations as two of the tongues 72. The feet 80 are curved in such a manner that they at least approximately form sections of generatrices of a circular cylinder. The ends of the feet 80 pointing toward the bottom 57 each have a depression 81 designed away from the bottom 57. The depression 81 is limited on both sides by means of an edge in each case. The edge of one side of the depression 81 is lower than the edge on the other side of the depression 81. The annular section 71 is provided on its inner edge in the peripheral direction with a radial recess 82 next to each of the feet 80. It is also possible to arrange a recess 82 on both sides respectively of one foot 80.

In the following, the assembly of the holder 50 will be explained in more detail. Firstly, the first contact element 59 is inserted into the holder 50 along the longitudinal axis 53, until its planar section 60 comes to rest on the bottom 57. The first contact element 59 is held in the holder 50 by means of the hooks 64 hooking into the latter. Subsequently, the lamp carrier 70 is inserted into the holder 50 along the longitudinal axis 53, until the said lamp carrier 70 comes to rest with the ends of its arms 74 on the bottom of the recesses 77. In this position, the tongues 72 engage in the openings 73, with the result that the lamp carrier 70 is held in the holder 50. As shown in FIG. 1, the light source 38 which can be inserted into the lamp carrier 70 has an approximately circular cylindrical base 85, on whose end is arranged an electrical contact 86 which is used for connecting the light source 38 to the positive terminal of a voltage source. Two pins 87 project radially outward from the periphery of the base 85 at a spacing from each other, at least one of the said pins 87 being used as electrical contact for connecting the light source 38 to ground. In the course of inserting the light source 38 into the holder 50, its base 85 is introduced through the annular section 71 of the lamp carrier 70, specifically in a rotational position in which its pins 87 can penetrate through the recesses 82 next to the feet 80. After a specific insertion path of the light source 38 in the direction of the longitudinal axis 53, its contact 86 comes to rest on the contact arm 61 of the contact element 59 and, on further inserting the light source 38, the said contact arm 61 is bent resiliently toward the bottom 57. Following further insertion of the light source 38 over a specific distance, the latter can be rotated in the lamp carrier 70 about the longitudinal axis 53, its pins 87 then being able to slide over the lower edge of the depression 81 into the depression 81. Further rotation of the light source 38 beyond the depression 81 is then prevented by the higher edge of the depression 81 on the other side. By means of the restoring force of the contact arm 61, the light source 38 is pressed away from the bottom 57, with the result that its pins 87 are held in the contact position in the depression 81 and the electrical connection of the pins 87 to the lamp carrier 70 is ensured.

Figure 5:
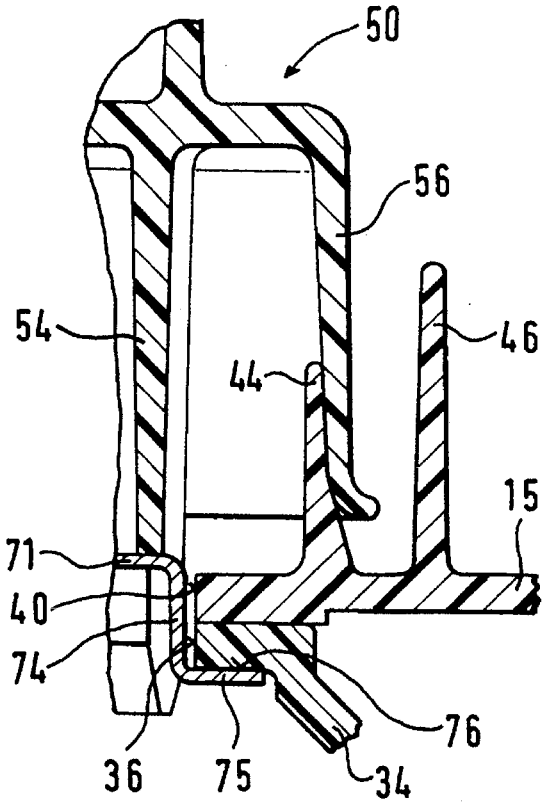
FIG. 5 shows a partial section along line V—V in FIG. 3.

For fastening the holder 50 to the housing 14 and to the reflector 34, respectively, the light source 38 inserted in the former is introduced through the opening 40 in the housing rear wall 15 and the opening 36 in the reflector 34 in the direction of arrow 90. The holder 50 is in this case located in a rotational position in which the end regions 75 of the arms 74 of the lamp carrier 70 can pass through the radial cutouts 42 of the openings 36 and 40. The main body 54 of the covering 52 likewise passes through the openings 36 and 40, while the cylindrical section 56 is arranged outside the opening 40 and outside the housing 14. After a specific insertion distance of the holder 50 in the direction of arrow 90, the section 56 with its conical inner surface comes to rest on the conical outer surface of the collar 44 and, on further insertion, the section 56 is radially resiliently expanded somewhat. After a further insertion distance, the end regions 75 of the arms 74 of the lamp carrier 70 pass through the opening 36 into the reflector 34, with the result that the holder 50 can be rotated about the longitudinal axis 53 in the direction of arrow 91 into a locking position. In so doing, the end regions 75 come alongside the radial cutouts 42 of the opening 36 and engage, as shown in FIG. 5 on the inside of the reflector 34 with their shoulders 76, so that the holder 50 can no longer be pulled out along its longitudinal axis 53 in the direction opposite to arrow 90. The U-shaped sections 65 and 79 of the contact element 59 or of the lamp carrier 70, respectively, point with their free limbs in the direction of rotation 91 and, in the rotational position of the holder 50 in which the latter is introduced through the openings 36 and 40, are arranged in a direction opposite to the direction of rotation 91 next to the connecting elements 48 projecting outward through the housing rear wall 15. Upon rotating the holder 50 in the direction of arrow 91 into the locking position, the U-shaped sections 65 and 79 are simultaneously rotated, one of the connecting elements 48 in each case entering between the limbs of the said sections 65, while resiliently bending up the same. Thus, during fitting of the holder 50, the connection of the contact elements 59 and 70 to the connecting elements 48 on the housing 14 is sealed by means of that section 56 of the covering 52 which rests with its inner surface on the outer surface of the collar 44. The section 56 is surrounded by the further collar 46, which additionally forms a protection against splash water and thus improved the sealing of the opening 40.

On the side of the covering 52 pointing away from the housing 14, a projection 92 can stick out and can be engaged for manipulating the holder 50. The projection 92 can have any desired shape in cross-section at right angles to the longitudinal axis 43, for example that of a hexagon, and can be provided with a fluting.

The lamp 12 does not necessarily need to have the reflector 34, and then the end regions 75 of the arm 74 of the lamp carrier 70 engage on the inside of the housing rear wall 15 for fastening the holder 50. The light source 38 can also have a plurality of contacts 86, and separate contact elements 59 then are provided in the holder 50, corresponding to the number of contacts 86, and a plurality of connecting elements 48 then are provided on the housing 14 in a corresponding fashion.

All the electrical connections of the lighting device can be produced via the plug part 26, for further light sources and also for electrical adjusting devices of the headlight 10 for adjusting the headlight range.

It will be understood that each of the elements described above, or two or more together, may also find a useful application in other types of constructions differing from the types described above.

While the invention has been illustrated and described as embodied in a lighting device for vehicles, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A lighting device for vehicles, comprising a housing; at least one light source; a holder fastenable to said housing and formed so that said at least one light source is insertable in said holder, said holder being provided with at least one electrical contact element on which said light source comes to rest; at least one electrical lead connected with said at least one electrical contact and connectable to a voltage source, said holder having a covering composed of an electrically insulating material; a plug including a plug part; at least one electrical connecting element connected with said plug part and arranged on one part of said housing, said connecting element being bringable to rest at said at least one contact element of said holder under the action of a spring force in built-in position of said holder in said housing, said light source being insertable in said housing, said plug being arranged on said housing, said housing having an opening through which a section of said holder passes in an axial insertion direction, and a collar at least approximately coaxially surrounding said opening and sticking out to an outside of said housing, said covering of said holder having a section which at least approximately coaxially surrounds said collar toward an outside of said housing, said section of said covering cooperating with said collar for sealing said opening, said at least one connecting element extending outwardly inside said collar.

2. A lighting device as defined in claim 1, wherein at least one of said contact element and said connecting element is resilient so as to produce said spring force.

3. A lighting device as defined in claim 1, wherein said at least one contact element has a section which is U-shaped with limbs which are resiliently expandable, said at least one connecting element is insertable between said limbs with resiliently expanding said limbs.

4. A lighting device as defined in claim 1, wherein said light source is insertable in said housing, said plug being arranged on said housing.

5. A lighting device as defined in claim 1; and further comprising electrical lead devices which connect said at least one connecting element to said plug part and are arranged inside said housing.

6. A lighting device as defined in claim 1, wherein said at least one connecting element extends through said housing and has a section projecting outside of said housing and resting on said contact element of said holder.

7. A lighting device as defined in claim 1, wherein said housing has an opening through which a section of said holder passes in an axial insertion direction, said holder resting on an outside of the housing after a predetermined axial insertion distance and is rotatable in a locking position in a fastening direction, said contact element coming to rest on said at least one connecting element during the rotation of said holder in said fastening direction.

8. A lighting device as defined in claim 7, wherein said opening has an edge provided with a plurality of radial cutouts, said section of said holder passing through said opening having a plurality of corresponding radial projections with shoulder pointing axially in a direction opposite to said insertion direction, said shoulders engaging on an inside of said housing during rotation of said holder in said fastening direction.

9. A lighting device as defined in claim 7; and further comprising a reflector arranged in said housing and having an opening arranged at least approximately coaxially with said opening of said housing, said opening of said reflector and said opening of said housing each having an edge with a plurality of radial cutouts, said section of said holder passing through said openings and having a plurality of corresponding projections with shoulder pointing axially in a direction opposite to said insertion direction, said shoulders engaging on an inside of said reflector during rotation of said holder in said fastening direction.

10. A lighting device as defined in claim 1, wherein said housing has an opening through which a section of said holder passes in an axial insertion direction, and a collar at least approximately coaxially surrounding said opening and sticking out to an outside of said housing, said covering of said holder having a section which at least approximately coaxially surrounds said collar toward an outside of said housing, said section of said covering cooperating with said collar for sealing said opening.

11. A lighting device as defined in claim 10, wherein said at least one connecting element extends outwardly inside said collar.

12. A lighting device as defined in claim 11, wherein said section of said covering is radially elastically deformable, said collar being formed so as to taper away from said housing.

13. A lighting device as defined in claim 11, wherein said housing is provided with a further collar which surrounds said first mentioned collar and said section of said covering and sticks out to an outside of said housing.

14. A lighting device as defined in claim 1; and further comprising at least one headlight and at least one lamp, said housing being formed as a common housing for said at least one headlight and said at least one lamp, said holder being associated with said at least one lamp.

15. A lighting device as defined in claim 14, wherein said at least one headlight has a light source; and further comprising at least one electrical lead device which contacts said light source of said headlight and is connected to said plug part.

* * * * *